US006083897A

United States Patent [19]

Lewis et al.

[11] Patent Number: 6,083,897

[45] Date of Patent: Jul. 4, 2000

[54] SOLUBILIZATION OF LOW 2-PHENYL ALKYLBENZENE SULFONATES

[75] Inventors: Ronald G. Lewis; David C. Lewis, both of Austin, Tex.

[73] Assignee: Huntsman Petrochemical Corporation, Austin, Tex.

[21] Appl. No.: 09/143,177

[22] Filed: Aug. 28, 1998

[51] Int. Cl.[7] ..... C11D 17/00; C11D 17/08

[52] U.S. Cl. ..... 510/351; 510/421; 510/424; 510/426; 510/427; 510/432

[58] Field of Search ..... 510/351, 421, 510/424, 426, 427, 432

[56] References Cited

U.S. PATENT DOCUMENTS

| | | | |
|---|---|---|---|
| 3,349,141 | 10/1967 | Sweeney . | |
| 3,776,962 | 12/1973 | Alul et al. | 260/624 C |
| 3,951,960 | 4/1976 | Heath et al. . | |
| 3,980,713 | 9/1976 | Matsunaga et al. . | |
| 3,985,687 | 10/1976 | Inamorato et al. | 252/551 |
| 3,993,659 | 11/1976 | Meyer . | |
| 4,028,283 | 6/1977 | Murata et al. | 252/551 |
| 4,244,840 | 1/1981 | Straw | 252/540 |
| 4,301,317 | 11/1981 | Young | 585/455 |
| 4,396,520 | 8/1983 | Payne et al. . | |
| 4,618,446 | 10/1986 | Haslop et al. . | |
| 4,645,623 | 2/1987 | Dolan et al. | 252/558 |
| 4,663,069 | 5/1987 | Lienado . | |
| 4,668,423 | 5/1987 | Drozd et al. . | |
| 4,687,593 | 8/1987 | Dolan et al. | 252/182 |
| 4,692,271 | 9/1987 | Messenger et al. . | |
| 4,746,461 | 5/1988 | Zielske . | |
| 4,753,754 | 6/1988 | Messenger et al. . | |
| 4,760,200 | 7/1988 | Keen et al. . | |
| 4,973,780 | 11/1990 | Johnson et al. | 585/467 |
| 5,034,564 | 7/1991 | Kocal | 585/467 |
| 5,086,193 | 2/1992 | Sy | 585/446 |
| 5,146,026 | 9/1992 | Berna Tejero et al. | 585/467 |
| 5,147,576 | 9/1992 | Montague et al. . | |
| 5,152,933 | 10/1992 | Holland | 252/559 |
| 5,167,872 | 12/1992 | Pancheri et al. | 252/544 |
| 5,196,574 | 3/1993 | Kocal | 562/94 |
| 5,242,615 | 9/1993 | Urfer et al. . | |
| 5,256,828 | 10/1993 | Cuscurida et al. . | |
| 5,273,644 | 12/1993 | Wegerer | 208/66 |
| 5,344,997 | 9/1994 | Kocal | 568/628 |
| 5,415,814 | 5/1995 | Ofosu-Asante et al. | 252/558 |
| 5,446,223 | 8/1995 | Smith, Jr. et al. | 585/313 |
| 5,550,115 | 8/1996 | Garst et al. . | |
| 5,580,848 | 12/1996 | Drapier | 510/417 |
| 5,631,205 | 5/1997 | Killick et al. . | |
| 5,703,028 | 12/1997 | Erilli et al. | 510/236 |
| 5,716,925 | 2/1998 | Mondin et al. | 510/365 |
| 5,719,118 | 2/1998 | Crutcher et al. . | |
| 5,780,417 | 7/1998 | Gorlin | 510/426 |

FOREIGN PATENT DOCUMENTS

| | | |
|---|---|---|
| 0038101 | 10/1981 | European Pat. Off. . |
| 0113978 | 12/1983 | European Pat. Off. . |
| 0151884 | 8/1985 | European Pat. Off. . |
| 0160144 | 11/1985 | European Pat. Off. . |
| 0160145 | 11/1985 | European Pat. Off. . |
| 0353813 | 2/1990 | European Pat. Off. . |
| 0633307A1 | 7/1994 | European Pat. Off. . |
| WO 93/00317 | 1/1993 | WIPO . |
| WO 95/31528 | 11/1995 | WIPO . |
| WO 97/04064 | 2/1997 | WIPO . |
| WO 97/39089 | 10/1997 | WIPO . |
| WO 97/39095 | 10/1997 | WIPO . |
| WO 97/47717 | 12/1997 | WIPO . |
| WO 98/00509 | 1/1998 | WIPO . |
| WO 98/46721 | 10/1998 | WIPO . |

OTHER PUBLICATIONS

Goddard, "Polymer–surfactant interaction Part I. Uncharged water–solublel polymers and charged surfactants," *Colloids and Surfaces,* 19:255–300, 1986. NMA.

Gorlin et al., "Liquid automatic dishwasher detergents," In: *Liquid Detergents,* Kuo–Yann Lai (Ed.), Marcel Dekker, Inc., NY, Chapter 9, pp. 325–380, 1997. NMA.

Huntsman brochure entitled: "Surfactants: A complete line of specialty surfactants and intermediates," 1996. NMA.

Huntsman brochure entitled: "Surfactants: Detergents," 1996. NMA.

Huntsman brochure entitled: "Surfactants: Linear Alkylbenzenes Alkylate 215, 225 & 229," 1996. NMA.

Huntsman brochure entitled: "Surfactants: Product flow chart," 1998. NMA.

Huntsman Technical Bulletin, ALKYLATE 215, 1997. NMA.

Huntsman Technical Bulletin, ALKYLATE 225, 1997. NMA.

Huntsman Technical Bulletin, ALKYLATE 229, 1997. NMA.

Huntsman Surfactant Application Notes, vol. 2, POGOL ™Polyethylene Glycols, 1997. NMA.

Huntsman Technical Bulletin, Surfonic®POA–L42, 1997. NMA.

Huntsman Technical Bulletin, Surfonic®POA–L44, 1997. NMA.

Huntsman Technical Bulletin, Surfonic®POA–L61, 1997. NMA.

Huntsman Technical Bulletin, Surfonic®POA–L62, 1997. NMA.

Huntsman Technical Bulletin, Surfonic®POA–L62LF, 1997. NMA.

Huntsman Technical Bulletin, Surfonic®POA–L64, 1997. NMA.

(List continued on next page.)

*Primary Examiner*—Necholus Ogden
*Attorney, Agent, or Firm*—O'Keefe, Egan & Peterman

[57] ABSTRACT

Methods and compositions relating to solubilization of alkylbenzene sulfonate surfactants in detergent formulations. Addition of one or more polyethylene glycols to detergents including low 2-phenyl linear alkylbenzene sulfonate surfactants may be used to increase solubility of the low 2-phenyl linear alkylbenzene sulfonate surfactants. Increased solubility of the low 2-phenyl linear alkylbenzene sulfonate surfactants serves to lower the cloud point of the detergents, permitting formulation of liquid detergent compositions containing greater concentrations of low 2-phenyl linear alkylbenzene sulfonate surfactants.

41 Claims, No Drawings

OTHER PUBLICATIONS

Huntsman Technical Bulletin, Surfonic®POA–L81, 1997. NMA.
Huntsman Technical Bulletin, Surfonic®POA–L101, 1997. NMA.
Huntsman Technical Bulletin, Surfonic®POA–25R2, 1997. NMA.
Huntsman Technical Bulletin, POGOL™ 200 Polyethylene Glycol, 1997. NMA.
Brown et al., "Poly(ethylene oxide)–sodium dodecyl sulfate interactions studied using static and dynamic light scattering," *Macromolecules,* 25:7192–7198, 1992. NMA.
Cohen et al., "Influence of 2–phenyl alkane and tetralin content on solubility and viscosity of linear alkylbenzene sulfonate," *JAOCS,* 72(1):115–122, 1995. NMA.
Contractor et al., "Interaction of PEO–PS–PEO block copolymers with ionic surfactants in aqueous solution," *Pure Appl. Chem.,* A34(12):2497–2507, 1997.
Cox and Smith, "Effect of LAB composition on LAS performance," *INFORM,* 8(1):19–24, 1997. NMA.
de Ameida et al., "Linear alkylbenzene," *JAOCS,* 71(7):675–693, 1994. NMA.
Drozd, "An introduction to light duty (dishwashing) liquids Part I. Raw materials," *Chemical Times & Trends,* pp. 29–57, 1984. NMA.
Drozd and Gorman, "Formulating characteristics of high and low 2–phenyl linear alkylbenzene sulfonates in liquid detergents," *JAOCS,* 65(3):398–404, 1988. NMA.
"Formulating Characteristics of High and Low 2–Phenyl Linear Alkylbenzene Sulfonates in Liquid Detergents," Presented at 77th Annual AOCS Meeting, May 17, 1986, Honolulu, HI by Stepan Company, Northfield, IL.
Friberg and Chiu, "Hydrotropes," *J. Dispersion Sci. Technol.,* 9(5&6):443–457, 1988–89.
Witco brochure entitled "Fabric Care: Surfactant & Specialty Products," 1996. NMA.
Co–pending U.S. application No. 09/303,096 dated Apr. 29, 1999. NMA.
Blease et al., In: *Defoaming Theory and Industrial Applications,* P.R. Garrett (Ed.), Ch. 8, pp. 299–323, 1993.
Co–Pending U.S. application No. 60/115,408 filed Jan. 11, 1999 (HNTC:064PZ1).
Co–Pending U.S. application No. 60/139,441 filed Jun. 15, 1999 (HNTC:064PZ2).
Co–Pending U.S. Provisional Patent Application Entitled "Concentrated Surfactant Blends," filed Jun. 30, 1999 (HNTC:066PZ1).
"Surfactants Literature," 1999. NMA.
Akzo Nobel catalog entitled "Surface Chemistry: Industrial surfactants general catalog, nitrogen derivatives."NMA.
Friberg, "Microemulsions and micellar solutions," *Microemulsions Theory and Practice,* p. 133–134. NMA.
Huntsman brochure entitled "Surfactants: SURFONIC® Alcohol Ethoxylates," 1996. NMA.
Huntsman brochure entitled "Surfactants: SURFONIC® Alkylphenol Ethoxylates," 1996. NMA.
Huntsman Technical Bulletin, SURFONIC® PEA–25, 1999. NMA.
Huntsman Technical Bulletin, SURFONIC® T–15, 1999. NMA.
Kirk–Othmer ed. "Microemulsions," *Ency. of Chem. Tech.,* Supplement vol., pp. 299–303. NMA.
Kirk–Othmer ed. "Surfactants," *Ency. of Chem. Tech.,* 23:478–491. NMA.
Pillai and Shah, eds., *Dynamic Properties of Interfaces and Association Structures,* pp. 55, 127, 142, 156, 178, 179, 183, 194, 196, 233, 264.
Prince, "Schulman's microemulsions," *Microemulsions Theory and Practice,* p. 1–4, 8–9, 17–18, 113–114, 116. NMA.
Rosano and Clausse, eds., *Microemulsion Systems,* p. 280. NMA.
Stepan brochure entitled "Your complete surfactant source." NMA.
Tomah Products, Inc. brochure entitled "The Chemistry of Tomah Products, Inc." NMA.
Moreno et al., "Influence of structure and counterions on physicochemical properties of linear alkylbenzene sulfonates," *JAOCS,* 67(8):547–552, 1990. NMA.
Nace (Ed.), In: *Nonionic Surfactants: Polyoxyalkylene Block Copolymers,* vol. 60, Marcel Dekker, Inc., NY, 1996. NMA.
*Pluronic & Tetronic Block Copolymer Surfactants,* BASF Catalogue, pp 1–29, 1989. NMA.
Sachdev and Krishnan, "Heavy–duty liquid detergents," In: *Liquid Detergents,* Kuo–Yann Lai (Ed.), Marcel Dekker, Inc., NY, Chapter 8, pp. 261–324, 1997. NMA.
Smith, "Impact of composition on the performance of sodium linear alkylbenzenesulfonate (NaLAS)," *JAOCS,* 74(7):837–845, 1997.
Sweeney and Olson, "Performance of straigh–chain alkylbenzene sulfonates (LAS) in heavy–duty detergents," 41:815–822, 1964. NMA.
Tjepkema et al., "Relationship between the structure of phenyldodecane isomers and their performance as detergent base materials," *Fifth World Petroleum Congress,* Section IV–Paper 21, pp 237–243, 1959. NMA.
van Os et al., "Alkylarenesulphonates: The effect of chemical structure on physico–chemical properties," *Tenside Surf. Det.,* 29(3):175–189, 1992. NMA.
Co–pending U.S. application No. 09/141,660 filed Aug. 28, 1998 (HNTC:060).
Co–pending U.S. application No. 08/598,692 filed Feb. 8, 1996 (HNSC:002).
Huntsman Technical Bulletin, POGOL™ 300 Polyethylene Glycol, 1997. NMA.
Huntsman Technical Bulletin, POGOL™ 400 Polyethylene Glycol, 1997.
Huntsman Technical Bulletin, POGOL™ 500 Polyethylene Glycol, 1997. NMA.
Huntsman Technical Bulletin, POGOL™ 600 Polyethylene Glycol, 1997.
Huntsman Technical Bulletin, POGOL™ 900 Polyethylene Glycol, 1997. NMA.
Huntsman Technical Bulletin, POGOL™ 1000 Polyethylene Glycol, 1997. NMA.
Huntsman Technical Bulletin, POGOL™ 1005 Polyethylene Glycol, 1997. NMA.
Huntsman Technical Bulletin, POGOL™ 1450 Polyethylene Glycol, 1997. NMA.
Xia et al., "Complex formation between poly(oxyethylene) and sodium dodecyl sulfate micelles: light scattering, electrophoresis, and dialysis equilibrium studies," *J. Phys. Chem.,* 96:6805–6811, 1992. NMA.
Jakobi and Löhr, In: *Detergents and Textile Washing: Principles and Practice,* Henkel KGaA, Düsseldorf, pp 41–107, 1987. NMA.

Lai et al., "Light–duty liquid detergents," In: *Liquid Detergents,* Kuo–Yann Lai (Ed.), Marcel Dekker, Inc., NY, Chapter 7, pp. 207–260, 1997. NMA.

Loughney and Quencer, "Surfactants for high–performance cleaning," *Soap/Cosmetics/Chemical Specialties,* pp 24–30, Jan., 1992.

Maltesh and Somasundaran, "Effect of binding of cations to polyethylene glycol on its interactions with sodium dodecyl sulfate," *Langmuir,* 8:1926–1930, 1992. NMA.

Matheson and Matson, "Effect of carbon chain and phenyl isomer distribution on use properties of linear alkylbenzene sulfonate: a comparison of 'high' and 'low' 2–phenyl LAS homologs," *JAOCS,* 60(9):1693–1698, 1983. NMA.

Milwidsky, "Variations of Neutralizing Cations and Their Effects on Las Properties," *HAPPI,* pp 44, 48, Jan. 1984. NMA.

Moreno et al., "Influence of unsulfonated material and its sulfone content on the physical properties of linear alkylbenzene sulfonates," *JAOCS,* 65(6):1000–1006, 1988. NMA.

Hawyley's Condensed Chemical Dictionary, p. 705 *NMA.

Alberty and Daniels Physical Chemistry, 5th Ed., pp. 616–617 *NMA.

Clint, Surfactant Aggregation; pp. 160–170, 1992 *NMA.

Christian and Scamehorn, Solubilization in Suractant Aggregates; pp. 118–120, 1995 *NMA.

International Search Report for PCT/US99/19176.

Interanational Search Report for PCT/US99/19588.

SOLUBILIZATION OF LOW 2-PHENYL ALKYLBENZENE SULFONATES

BACKGROUND OF THE INVENTION

1. Field of the Invention

The present invention relates generally to liquid cleanser compositions and, more particularly, to solubility enhancement of alkylbenzene sulfonates, such as low 2-phenyl alkylbenzene sulfonates, in aqueous cleanser formulations by addition of polyethylene glycols.

2. Description of Related Art

Linear alkylbenzene sulfonates ("LAS") are widely used surfactants in commercial cleanser products because of their effectiveness as detergents, ease of biodegradation, and relative low cost. Typically, linear alkylbenzene sulfonates are produced via sulfonation of linear alkylbenzene intermediates.

Linear alkylbenzene is typically manufactured on an industrial scale using one of two commercial processes which differ from one another primarily by virtue of the catalyst system employed. In this regard, one process employs an aluminum trichloride catalyst, while the other process uses a hydrogen fluoride catalyst. The two processes result in linear alkylbenzene products with different phenyl isomer distributions. For example, a typical phenyl isomer distribution for products of the aluminum trichloride process is about 30% 2-phenyl isomer and about 22% 3-phenyl isomer. In contrast, a typical phenyl isomer distribution for products of the hydrogen fluoride process is about 20% 2-phenyl isomer and about 20% 3-phenyl isomer, although reported values may differ. The product of the aluminum trichloride process, which is relatively high in 2-phenyl isomer content, is often referred to as "high 2-phenyl" linear alkylbenzene, whereas the product of the hydrogen fluoride process, which is relatively low in 2-phenyl isomer content, is often referred to as "low 2-phenyl" linear alkylbenzene.

The sulfonates of linear alkylbenzenes are known to exhibit different physical properties depending upon the position of the aromatic group on the alkyl chain. Therefore, high 2-phenyl linear alkylbenzene sulfonates have physical properties that differ from low 2-phenyl linear alkylbenzene sulfonates. For example, high 2-phenyl linear alkylbenzene sulfonates typically have a higher solubility in aqueous media than do low 2-phenyl linear alkylbenzene sulfonates. Furthermore, an aqueous solution comprising a high 2-phenyl linear alkylbenzene sulfonate may exhibit a higher viscosity than an aqueous solution comprising a low 2-phenyl linear alkylbenzene sulfonate. In cases where maximum solubility of linear alkylbenzene sulfonate in an aqueous detergent formulation is of concern, a product containing a relatively high percentage of compounds in which the aromatic substituent is in the 2 or 3 position and a correspondingly smaller percentage of isomers in which the aromatic substituent is positioned centrally with respect to the alkyl chain may be advantageous.

In the past, poor aqueous solubility has typically precluded the use of low 2-phenyl linear alkylbenzene sulfonates in detersive applications requiring a liquid formulation. For example, heavy duty liquid laundry detergents and liquid dishwashing detergent products have typically employed the more soluble high 2-phenyl linear alkylbenzene sulfonates as anionic surfactants. However, the relative high cost of high 2-phenyl surfactants often presents a disadvantage to cost-conscious detergent formulators and marketers. The higher cost of high 2-phenyl linear alkylbenzene sulfonates compared to low 2-phenyl surfactants stems from the greater expense associated with the aluminum trichloride process relative to the hydrogen fluoride process.

Attempts have been made to reduce the cost of liquid detergent formulations employing linear alkylbenzene sulfonates. Typically, these have included attempts to facilitate the use of the relatively less expensive low 2-phenyl linear alkyl benzene sulfonates. For example, one method typically employed for improving solubility of low 2-phenyl linear alkylbenzene sulfonates in liquid detergent formulations has involved the addition of hydrotropes, such as sodium xylene sulfonate. As used herein, the term "hydrotrope" is defined to be a compound that has the property of increasing the aqueous solubility of various slightly soluble organic chemicals. However, the cost advantage of low 2-phenyl formulations may be partially or completely offset by the cost of the relatively large amount of hydrotropes typically required to effect improved low 2-phenyl surfactant solubility without any accompanying improvement in the detergency characteristics of the formulation. Furthermore, addition of large amounts of hydrotropes to a detergent formulation may have the undesirable effect of lowering the viscosity of the detergent.

SUMMARY OF THE INVENTION

In one respect, this invention is a surfactant composition including at least one alkylbenzene sulfonate and at least one polyethylene glycol solubility enhancer. The alkylbenzene sulfonate may be a low 2-phenyl alkylbenzene sulfonate. The alkylbenzene sulfonate may be a low 2-phenyl alkylbenzene sulfonate. The alkylbenzene sulfonate may be a linear alkylbenzene sulfonate having a 2-phenyl isomer content of less than or equal to 25% by weight. The alkylbenzene sulfonate may be a linear alkylbenzene sulfonate having a 2-phenyl isomer content of up to about 20% by weight. The surfactant composition may further include a solvent. The solvent may include at least one of water, alcohol, glycol, glycol ether, or mixture thereof. A cation of the low 2-phenyl alkylbenzene sulfonate may include, among other things, at least one of ammonium, a substituted ammonium, an alkali metal, an alkaline earth metal, or a mixture thereof. The alkali metal may include sodium. In one embodiment, the polyethylene glycol solubility enhancer may have an average molecular weight from about 200 to about 900. In another embodiment, the polyethylene glycol solubility enhancer may have an average molecular weight equal to or less than 400. In another embodiment, the polyethylene glycol solubility enhancer may have an average molecular weight from about 200 to about 300. In one embodiment, the low 2-phenyl alkylbenzene sulfonate may be present in an amount from about 10% to about 30% by total weight of the composition, and the polyethylene glycol solubility enhancer may be present in an amount from about 0.5% to about 10% by total weight of the composition. In another embodiment, the low 2-phenyl alkylbenzene sulfonate may be present in an amount from about 15% to about 30% by total weight of the composition, and wherein the polyethylene glycol solubility enhancer may be present in an amount from about 0.8% to about 8% by total weight of the composition. In another embodiment, the polyethylene glycol solubility enhancer may be present in a mole ratio from about 0.01 to about 0.50 relative to the low 2-phenyl alkylbenzene sulfonate.

In another respect, this invention is a surfactant composition including a solvent, from about 2% to about 40% of linear alkylbenzene sulfonate by total weight of the composition, and from about 0.2% to about 20% polyethylene glycol by total weight of the composition; wherein the linear alkylbenzene sulfonate has a 2-phenyl isomer content of from about 14% to less than or equal to 25% by weight.

The solvent may include, but is not limited to, at least one of water, alcohol, glycol, glycol ether, or a mixture thereof In one embodiment, the solvent may include at least one of water, alcohol having from 1 to about 6 carbon atoms, or a mixture thereof. In another embodiment, an alkyl chain of the alkylbenzene sulfonate surfactant may contain from about 8 to about 16 carbon atoms. A cation of the linear alkylbenzene sulfonate surfactant may include sodium. In one embodiment, the polyethylene glycol solubility enhancer may have a molecular weight between about 200 and about 900. In another embodiment, the polyethylene glycol solubility enhancer may have an average molecular weight of less than 400. In another embodiment, polyethylene glycol solubility enhancer may have an average molecular weight from about 200 to about 300. In one embodiment, the cloud point of the surfactant composition, typically a sodium LAS-containing composition, may be about 15° C. or lower, alternatively from about 15° C. to about −15° C., or alternatively from about 15° C. to about −10° C. In another embodiment, the cloud point of the surfactant composition, typically a sodium LAS-containing solution, may be about 10° C. or lower, alternatively from about 10° C. to about −15° C., or alternatively from about 10° C. to about −10° C. In still another embodiment, the clear point of the surfactant solution, typically a sodium LAS-containing solution, may be about 25° C. or lower, alternatively from about 25° C. to about −5°, or alternatively from about 25° C. to about −2° C. In still another embodiment, the clear point of the surfactant solution, typically a sodium LAS-containing solution, may be about 15° C. or lower, alternatively from abut 15° C. to about −5° C., or alternatively from about 15° C. to about −2° C. In still another embodiment, a surfactant composition, typically a sodium LAS-containing composition, may have a reduction in cloud point of between about 10° C. and about 40° C. as compared to a conventional sodium LAS-containing composition lacking the disclosed polyethylene glycol solubility enhancer. In still another embodiment, a surfactant composition, typically a sodium LAS-containing composition, may have a reduction in clear point of between about 10° C. and about 40° C. as compared to a conventional sodium LAS-containing composition lacking the disclosed polyethylene glycol solubility enhancer/s.

In yet another respect, this invention is a surfactant composition including from about 2% to about 40% low 2-phenyl alkylbenzene sulfonate by total weight of the composition, from about 0.2% to about 20% polyethylene glycol by total weight of the composition, and from about 97.8% to about 40% solvent by total weight of the composition; and wherein the solvent includes at least one of water, alcohol, glycol, glycol ether, or a mixture thereof; wherein an alkyl chain of the low 2-phenyl linear alkylbenzene sulfonate surfactant contains from about 8 to about 16 carbon atoms; and wherein the polyethylene glycol solubility enhancer has a molecular weight of between about 200 and about 2000. In one embodiment, the polyethylene glycol solubility enhancer may have an average molecular weight of between about 200 and about 900. In another embodiment, the polyethylene glycol solubility enhancer may have an average molecular weight of less than 400. In another embodiment, the polyethylene glycol solubility enhancer may have an average molecular weight from about 200 to about 300. The solvent may include water. In one embodiment, the cloud point of the surfactant composition, typically a sodium LAS-containing composition, may be about 15° C. or lower, alternatively from about 15° C. to about −15° C., or alternatively from about 15° C. to about −10° C.; or the clear point of the surfactant composition may be about 25° C. or lower, alternatively from about 25° C. to about −5°, or alternatively from about 25° C. to about −2° C. In another embodiment, the surfactant composition, typically a sodium LAS-containing composition, may have a reduction in cloud point of between about 10° C. and about 40° C., or a reduction in clear point of between about 10° C. and about 40° C., as compared to a conventional sodium LAS-containing surfactant composition lacking the disclosed polyethylene glycol solubility enhancer/s. A cation of the 2-phenyl linear alkylbenzene sulfonate surfactant may include sodium.

In another respect, this invention is a method of enhancing solubility of alkylbenzene sulfonate in a surfactant composition including a solvent and alkylbenzene sulfonate, the method including adding a polyethylene glycol solubility enhancer to the surfactant composition. The alkylbenzene sulfonate may include low 2-phenyl alkylbenzene sulfonate. The alkylbenzene sulfonate may have a 2-phenyl isomer content of less than or equal to 25% by weight. The alkylbenzene sulfonate may have a 2-phenyl isomer content of up to about 20% by weight. The solvent may include, but is not limited to, at least one of water, alcohol having from 1 to about 6 carbon atoms, glycol, glycol ether, or mixture thereof. In one embodiment, the solvent may include water. A cation of the 2-phenyl alkylbenzene sulfonate surfactant may include sodium. In one embodiment, the polyethylene glycol solubility enhancer may have a molecular weight between about 200 and about 900. In another embodiment, the polyethylene glycol solubility enhancer may have a molecular weight of less than 400. In another embodiment, the polyethylene glycol solubility enhancer may have a molecular weight of from about 200 to about 300. In one embodiment, the step of adding polyethylene glycol solubility enhancer to the surfactant composition may include the step of adding a sufficient amount of polyethylene glycol solubility enhancer to the surfactant composition to result in a surfactant composition including from about 2% to about 40% low 2-phenyl alkylbenzene sulfonate by total weight of the composition, and from about 0.2% to about 20% polyethylene glycol by total weight of the composition.

In yet another embodiment, the step of adding may include adding a polyethylene glycol solubility enhancer to a surfactant composition, typically a sodium LAS-containing surfactant composition, and lowering the cloud point of the surfactant composition to about 15° C. or lower, alternatively to from about 15° C. to about −15° C., or alternatively to from about 15° C. to about −10° C.; or lowering the clear point of the surfactant composition to about 25° C. or lower, alternatively to from about 25° C. to about −5°, or alternatively to from about 25° C. to about −2° C. In another embodiment, the step of adding may include adding a polyethylene glycol solubility enhancer to a surfactant composition, typically a sodium LAS-containing composition, and lowering the cloud point of the surfactant composition by between about 10° C. and about 40° C.; or reducing the clear point of the surfactant composition by between about 10° C. and about 40° C., relative to a conventional sodium LAS-containing composition lacking the disclosed polyethylene glycol solubility enhancer/s.

The disclosed method and compositions relate to enhanced or improved solubilization of alkylbenzene sulfonates, such as low 2-phenyl alkylbenzene sulfonates in aqueous detergent formulations. Among other things, liquid surfactant compositions including linear alkylbenzene sulfonate surfactants are provided. In the practice of the disclosed method and compositions, addition of polyethylene glycols to surfactant compositions including low 2-phenyl linear alkylbenzene sulfonate surfactants surprisingly increases the solubility of the low 2-phenyl linear alkylbenzene sulfonates in aqueous solutions, resulting in lower cloud and clear points, and permitting formulation of liquid detergent compositions containing greater concentrations of relatively less expensive low 2-phenyl linear alkylbenzene sulfonates.

Advantageously, in the practice of the disclosed method, polyethylene glycols may be added to an aqueous surfactant composition containing linear alkylbenzene sulfonate, such as low 2-phenyl linear alkylbenzene sulfonate, to enhance the solubility of the low 2-phenyl linear alkylbenzene sulfonate. Solubility enhancement typically results in a lowering of the cloud and clear points of the composition. For example, the cloud point of a surfactant composition comprising water, sodium hydroxide, and a low 2-phenyl linear alkylbenzene sulfonate compound may typically be depressed below the freezing point of water (0° C.) or lower, depending upon the concentration of low 2-phenyl linear alkylbenzene sulfonate present and depending upon the amount of polyethylene glycol solubility enhancer added. In the practice of the disclosed method, addition of polyethylene glycol compound/s to an aqueous surfactant composition lowers the cloud point of the composition typically to as low as about 10° C. to about −8° C., more typically to as low as from about 5° C. to about −4° C., and most typically to as low as from about 0° C. to about −4° C.

Such a surfactant composition may also include one or more solvents, typically in addition to water, such as alcohols, glycols, glycol ethers, mixtures thereof, etc. Suitable alcohols include, but are not limited to, straight chain alkyl alcohols (including those containing from one to six carbon atoms, e.g., methanol, ethanol, n-propanol, n-hexanol, etc.), branched chain alkyl alcohols (including those containing from three to six carbon atoms, e.g., isopropanol and secondary butanol, etc.), glycols such as propylene glycol, diglycols such as propylene diglycol and triglycols such as triethylene glycol and glycol ethers such as butylene glycol diethylether and dipropylene glycol methylether. Such solvents (when added in addition to water), are typically added in an amount of between about 1% and about 20%, alternatively between about 5% and about 15%, alternatively between about 10% and about 15% by total weight of the composition, although greater or lesser amounts of such solvents may also be suitably employed.

DETAILED DESCRIPTION OF ILLUSTRATIVE EMBODIMENTS

The disclosed method and compositions relate to enhanced or improved solubilization of low 2-phenyl alkylbenzene sulfonates in aqueous detergent formulations. Among other things, liquid surfactant compositions comprising low 2-phenyl linear alkylbenzene sulfonate surfactants are provided.

In the practice of the disclosed method and compositions, addition of polyethylene glycols to surfactant compositions including low 2-phenyl linear alkylbenzene sulfonates surprisingly increases solubility of low 2-phenyl linear alkylbenzene sulfonates in an aqueous solution. Advantageously, increased solubility of low 2-phenyl linear alkylbenzene sulfonate results in lower solution cloud points and clear points and permits formulation of liquid detergent compositions containing greater concentrations of relatively less expensive low 2-phenyl linear alkylbenzene sulfonate surfactants.

As used herein, the term "cloud point" is defined as the temperature at which a substantially clear solution becomes opaque or cloudy. As used herein, the term "clear point" is defined as the temperature at which an opaque or cloudy solution becomes substantially clear. In either case, a substantially clear solution is a solution isotropic in appearance in which insoluble material is not visually discernible in the solution. In this regard, cloud point and/or clear point may be used as an indicator of the mutual solubility of the components in an aqueous solution. In the case of many detergent formulations incorporating LAS, this indicates the solubility/insolubility of the LAS component. In this regard, cloud point and/or clear point may be used as an indicator of the solubility of anionic surfactants in aqueous solution. All other parameters being equal, a lower cloud point and/or clear point is indicative of greater solute solubility. As illustrated in the examples included herein, cloud and clear point determinations show that the addition of relatively low molecular weight polyethylene glycols surprisingly increases solubility of low 2-phenyl linear alkylbenzene sulfonates in aqueous solutions, such as heavy duty liquid laundry detergent formulations. Advantageously, polyethylene glycol solubility enhancers of the disclosed method and compositions are capable of depressing the cloud and clear points of low 2-phenyl linear alkylbenzene sulfonate surfactants to temperatures lower than the cloud point temperatures typically achieved by hydrotropes. Further advantageously, the solubility enhancing effect of the disclosed surfactant compositions is typically attained using polyethylene glycol concentrations lower than those concentrations required for hydrotropes.

The disclosed method and compositions are useful with all types of liquid surfactant compositions in which linear alkyl benzene sulfonates are present as a surfactant component. Examples of such liquid compositions include, but are not limited to, heavy duty laundry detergents, herbicide emulsifiers, hard surface cleaners, bathroom cleaners, all purpose cleaners, car wash detergents, janitorial cleaners and light duty liquid detergents. Surprisingly, in accordance with the present disclosure, polyethylene glycol materials may be used to improve solubility of low 2-phenyl linear alkyl benzene sulfonates. Significantly, polyethylene glycol materials have been shown to offer superior solubility enhancing qualities over conventional solubility enhancers such as amines and hydrotrope materials. The addition of polyethylene glycols, most typically relatively lower molecular weight polyethylene glycols, acts to reduce the cloud and clear points of low 2-phenyl linear alkyl benzene sulfonate materials to lower temperatures. Thus, polyethylene glycols improve the solubility and applicability of low 2-phenyl linear alkyl benzene sulfonate materials in detergent formulations. The unexpected advantages of this method are the allowed use of low 2-phenyl linear alkyl benzene sulfonate products and/or the use of considerably higher levels of these products in liquid detergent formulations while retaining the desired stability and aesthetic properties of these formulations.

In the practice of the disclosed method and compositions, any low 2-phenyl alkylbenzene sulfonate compound/s or mixture thereof suitable for use in liquid detergent formulations may be employed. Typical low 2-phenyl alkyl benzene sulfonate compounds include, but are not limited to, those prepared by alkylating benzene with straight chain monoolefins in the presence of hydrogen fluoride as catalyst, followed by sulfonation with any suitable sulfonating agent.

For example, preparation of suitable low 2-phenyl alkylbenzene sulfonate compounds may include dehydrogenation of straight chain paraffins over a suitable catalyst, to provide a mixture containing the desired straight chain monoolefins as well as unreacted straight chain paraffins. This mixture may be passed to an alkylation unit wherein the straight chain monoolefins may be used to alkylate benzene to form the desired straight chain alkylbenzene compounds, as well as unreacted straight chain paraffins which may be readily separated therefrom by such procedures as distillation. Straight chain alkylbenzene compounds thus prepared may be sulfonated with any suitable sulfonating agent, such as sulfur trioxide, mixtures of sulfur dioxide and sulfur trioxide, chlorosulfonic acid, or the like, by conventional procedures. The resulting sulfonic acid may be neutralized with an alkali metal hydroxide or carbonate, such as potassium hydroxide or sodium carbonate, or by the use of any other suitable base conventionally employed in the preparation of ammonium or alkali metal salts of aryl sulfonic acids.

It will be understood that benefit of the disclosed method and compositions may be realized in solutions including any alkylbenzene sulfonate compounds, including those of varying molecular weights, alkyl chain length and alkyl chain phenyl location combination. Examples of such compounds are described in U.S. Pat. No. 3,776,962; U.S. Pat. No. 5,152,933; U.S. Pat. No. 5,167,872; Drazd, Joseph C. and Wilma Gorman, "Formulating Characteristics of High and Low 2-Phenyl Linear Alkylbenzene Sulfonates in Liquid Detergents," *JAOCS,* 65(3):398–404, March 1988; Sweeney, W. A. and A. C. Olson, "Performance of Straight-Chain Alkylbenzene Sulfonates (LAS) in Heavy-Duty Detergents," *JAOCS,* 41:815–822, December 1964.; Drazd, Joseph C., "An Introduction to Light Duty (Dishwashing) Liquids Part I. Raw Materials," *Chemical Times & Trends,* 29–58, January 1985; Cohen, L. et al., "Influence of 2-Phenyl Alkane and Tetralin Content on Solubility and Viscosity of Linear Alkylbenzene Sulfonate," *JAOCS,* 72(1):115–122, 1995; Smith, Dewey L., "Impact of Composition on the Performance of Sodium Linear Alkylbenzene-sulfonate (NaLAS)," *JAOCS,* 74(7):837–845, 1997; van Os, N. M. et al., "Alkylarenesulphonates: The Effect of Chemical Structure on Physico-chemical Properties," *Tenside Surf. Det.,* 29(3):175–189, 1992; Moreno, A. et al., "Influence of Structure and Counterions on Physicochemical Properties of Linear Alkylbenzene Sulfonates," *JAOCS,* 67(8):547–552, August 1990; Matheson, K. Lee and Ted P. Matson, "Effect of Carbon Chain and Phenyl Isomer Distribution on Use Properties of Linear Alkylbenzene Sulfonate: A Comparison of 'High' and 'Low' 2-Phenyl LAS Homologs," *JAOCS,* 60(9):1693–1698, September 1983; Cox, Michael F. and Dewey L. Smith, "Effect of LAB composition on LAS Performance," *INFORM,* 8(1):19–24, January 1997; and patent application Ser. No. 08/598,692 filed on Feb. 8, 1996; all of the foregoing references being incorporated herein by reference in their entirety.

In one embodiment, alkylbenzene sulfonate compounds used in accordance with the disclosed compositions and methods and having the characteristics described herein include those having a linear alkyl group. Typically linear alkyl chain lengths are between about 8 and about 16 carbon atoms, although greater and lesser lengths are possible. Typically, low 2-phenyl alkylbenzene sulfonates are employed. In this regard, suitable low 2-phenyl alkylbenzene sulfonate compositions may include mixtures of species having varying molecular weights. Typically, one or more low 2-phenyl alkylbenzene sulfonate compounds, as their sodium salts, having an average molecular weight in the range of from about 292 to about 404, and an average alkyl carbon number of from about 8 to about 16 are employed. Alternatively, one or more low 2-phenyl alkylbenzene sulfonate compounds, as their sodium salts, having an average molecular weight of from about 320 to about 376, and an average alkyl carbon number of from about 10 to about 14 are employed. Alternatively, one or more low 2-phenyl alkylbenzene sulfonate compounds, as their sodium salts, having an average molecular weight of from about 334 to about 362, and an average alkyl carbon number of from about 11 to about 13 are employed.

In other embodiments (such as those employing cations besides sodium), may also include mixtures of species having varying molecular weights. Typically, one or more low 2-phenyl alkylbenzene sulfonate compounds based on low 2-phenyl alkylbenzene sulfonate compounds having an average molecular weight in the range of from about 190 to about 302, and an average alkyl carbon number of from about 8 to about 16 are employed. Alternatively, one or more of such compounds based on low 2-phenyl alkylbenzene compounds having an average molecular weight of from about 218 to about 274, and an average alkyl carbon number of from about 10 to about 14 are employed. Alternatively, one or more of such compounds based on low 2-phenyl alkylbenzene compounds having an average molecular weight of from about 232 to about 260, and an average alkyl carbon number of from about 1 to about 13 are employed. Further possible embodiments are illustrated in Table 18, which lists molecular weight information for various low 2-phenyl alkylbenzene compounds having varying alkyl carbon chain lengths. Information is also provided for acid/sulfate and sodium/sulfate derivatives of these low 2-phenyl alkylbenzene compounds which are useful alone and in various combinations in the practice of the disclosed compounds and method.

Alkyl benzene sulfonates suitable for use in the disclosed method and compositions include any alkyl benzene sulfonates known in the art to be effective or suitable for detergent formulations including, but not limited to, those alkyl benzene sulfonates having a 2-phenyl isomer content of less than about 30% by weight of the molecule, alternatively less than about 29% by weight of the molecule, alternatively less than about 28% by weight of the molecule, alternatively less than about 27% by weight of the molecule, alternatively less than about 26% by weight of the molecule, alternatively less than about 25% by weight of the molecule, alternatively less than about 24% by weight of the molecule, alternatively less than about 23% by weight of the molecule, alternatively less than about 22% by weight of the molecule, alternatively less than about 21% by weight of the molecule, alternatively less than about 20% by weight of the molecule, and alternatively less than about 19% by weight of the molecule. However, with benefit of this disclosure it will be understood that alkyl benzene sulfonates having a 2-phenyl isomer content of 30% by weight of the molecule or greater may also be employed.

Also suitable are alkyl benzene sulfonates having a 2-phenyl isomer content of from about 10% to less than about 25% by weight of the molecule, alternatively from about 10% to about 24% by weight of the molecule, alternatively from about 10% to about 23% by weight of the molecule, alternatively from about 10% to about 22% by weight of the molecule, alternatively from about 10% to about 21% by weight of the molecule, alternatively from about 10% to about 20% by weight of the molecule, and alternatively from about 10% to about 19% by weight of the molecule.

Also suitable are alkyl benzene sulfonates having a 2-phenyl isomer content of from about 12% to less than about 25% by weight of the molecule, alternatively from about 12% to about 24% by weight of the molecule, alternatively from about 12% to about 23% by weight of the molecule, alternatively from about 12% to about 22% by weight of the molecule, alternatively from about 12% to about 21% by weight of the molecule, alternatively from about 12% to about 20% by weight of the molecule, and alternatively from about 12% to about 19% by weight of the molecule.

Also suitable are alkyl benzene sulfonates having a 2-phenyl isomer content of from about 14% to less than about 25% by weight of the molecule, alternatively from about 14% to about 24% by weight of the molecule, alternatively from about 14% to about 23% by weight of the molecule, alternatively from about 14% to about 22% by weight of the molecule, alternatively from about 14% to about 21% by weight of the molecule, and alternatively from about 14% to about 20% by weight of the molecule, and alternatively from about 14% to about 19% by weight of the molecule.

Also suitable are alkyl benzene sulfonates having a 2-phenyl isomer content of from about 15% to less than about 25% by weight of the molecule, alternatively from about 15% to about 24% by weight of the molecule, alternatively from about 15% to about 23% by weight of the molecule, alternatively from about 15% to about 22% by weight of the molecule, alternatively from about 15% to about 21% by weight of the molecule, and alternatively from about 15% to about 20% by weight of the molecule, and alternatively from about 15% to about 19% by weight of the molecule.

As used herein, the term "low 2-phenyl alkyl benzene sulfonate" includes those alkyl benzene sulfonates having a 2-phenyl isomer content of from about 14% to about 20% by weight. Typically the phenyl isomer distribution is substantially uniform across the alkane. As used herein, "high 2-phenyl alkylbenzene sulfonate" characterizes alkylbenzene sulfonates having a phenyl isomer content of from greater than 25% to about 30% 2-phenyl isomer by weight. Typically, the phenyl isomer distribution is predominately in the 2 and 3 position of the alkane. It will be understood by those of skill in the art with benefit of this disclosure that mixtures of low-2-phenyl and high 2-phenyl alkylbenzene sulfonates are also possible, thus yielding 2-phenyl isomer content values between those defined above for the low 2-phenyl and high 2- phenyl alkylbenzene sulfonates.

One specific low 2-phenyl alkylbenzene sulfonate composition is a sulfonate prepared from a linear alkyl benzene known as ALKYLATE 225™ (commercially available from Huntsman Specialty Chemicals Corporation). Other examples of suitable linear alkylbenzenes for preparing linear alkyl benzene sulfonates include, but are not limited to, ALKYLATE 215™, ALKYLATE 229™, ALKYLATE H230L™, and ALKYLATE H230H™ (also available from Huntsman Specialty Chemicals Corporation). Suitable processes for sulfonating such linear alkyl benzenes include, but are not limited to, those employing an air/$SO_3$ sulfonator or chlorosulfonic acid.

In the practice of the disclosed method and compositions, a low 2-phenyl linear alkylbenzene sulfonate may include any counterion or cation suitable for neutralization. In one embodiment a counterion or cation is typically ammonium or substituted ammonium. In this regard, a substituted ammonium may include, but is not limited to, monoethanol ammonium, diethanol ammonium, triethanol ammonium, or a mixture thereof In another embodiment, such a counterion or cation may be an alkali metal, an alkaline earth metal, or a mixture thereof. Typical alkali metals include, but are not limited to, lithium, sodium, potassium, cesium, or a mixture thereof. Typical alkaline earth metals include, but are not limited to, magnesium, calcium, strontium, barium, or a mixture thereof.

The disclosed surfactant compositions may be provided in solid form without a solvent, or in liquid form with a solvent. In those embodiments employing solvents, any solvent suitable for use in the formulation of a liquid detergent formulation may be employed. Suitable solvents include, for example, those solvents capable of dissolving low 2-phenyl linear alkylbenzene sulfonates. Examples of suitable solvents include, but are not limited to, water, alcohols, glycols and glycol ethers, or mixtures thereof. Specific examples of suitable alcohol solvents include, but are not limited to, alcohols having from about 1 to about 6 carbon atoms. In the practice of the disclosed method and compositions, typical specific solvents include water, straight chain alkyl alcohols containing from one to six carbon atoms (example: methanol, ethanol, n-propanol, n-hexanol, etc.), branched chain alkyl alcohols containing from three to six carbon atoms (example: isopropanol and secondary butanol), glycols such as propylene glycol, diglycols such as propylene diglycol and triglycols such as triethylene glycol and glycol ethers such as butylene glycol diethylether and dipropylene glycol methylether.

In the formulation and practice of the disclosed compositions and methods, any polyethylene glycol compound which is suitable for increasing solubility of a low 2-phenyl alkylbenzene sulfonate surfactant in an aqueous solution may be employed. Typical examples of suitable polyethylene glycol compounds include, but are not limited to, polyethylene glycol compounds having a molecular weight of greater than about 200, alternatively between about 200 and about 2000, alternatively between 200 and about 900, alternatively between about 300 and about 600, and alternatively between about 400 and about 500. Other examples include polyethylene glycols having a molecular weight of less than 500, alternatively having a molecular weight of less than 400, alternatively between less than 400 and about 200, alternatively less than about 300, and alternatively from about 200 to about 300.

One embodiment of the disclosed method and compositions employs one or more polyethylene glycol solubility enhancers having between about 4 and about 46, alternatively between about 4 and about 21, alternatively between about 7 and about 14, and alternatively between about 9 and about 12 ethylene glycol monomers joined by ether linkages. Specific examples of such polyethylene glycol compounds include, but are not limited to, polyethylene glycol products marketed by Huntsman Chemical Corporation under the trade name POGOL™ (such as, for example, POGOL 200™, POGOL 300™, POGOL 400™, POGOL 500™, POGOL 600™, and POGOL 900™). In the case of POGOL™ compounds, the numeric designation indicates the average molecular weight of the polyethylene glycol compounds.

The disclosed surfactant compositions including a solvent typically have reduced cloud and clear points relative to similar conventional surfactant/solvent compositions (i.e., with similar components, but without the disclosed polyethylene glycol solubility enhancer). With benefit of this disclosure, it will be understood by those of skill in the art that detergent compositions having any suitable amount of alkylbenzene sulfonate known in the art may benefit from the polyethylene glycol solubility enhancers of the present disclosure, and it will further be understood that any amount or mixture of polyethylene glycols effective for enhancing solubility of such alkylbenzene sulfonates in detergent compositions, and/or effective for lowering the cloud or clear point of such compositions, may be employed. Typically, sodium LAS embodiments of the disclosed surfactant compositions have reduced cloud and clear points of about 10° C. to about 35° C., alternatively from about 25° C. to about 30° C., relative to a similar conventional sodium LAS only composition.

In various embodiments, the disclosed sodium LAS-containing surfactant solutions may have cloud points equal to or less than about 15° C., about 10° C., about 5° C., about 0C. and about −5° C., respectively. In various other embodiments, the disclosed sodium LAS-containing surfactant solutions may have clear points of less than or equal to about 25° C., about 20° C., about 15° C., about 10° C., about 5° C., and about 0° C., respectively.

For example, in the practice of one embodiment of the disclosed method and compositions, a surfactant or detergent composition typically includes between about 2% and about 40% by weight of sodium low 2-phenyl linear alkylbenzene sulfonate surfactant, between about 0.2% and about 20% by weight of polyethylene glycol solubility enhancer (such as POGOL 400™, etc.), and between about 40% and about 97.8% by weight of water and/or alternatively other solvents (such as alcohol, glycol, glycol ether, etc.). In another embodiment, a surfactant composition may include between about 5% and about 30% by weight of sodium low 2-phenyl linear alkylbenzene sulfonate surfactant, between about 0.5% and about 10% by weight of polyethylene glycol (such as POGOL 400™, etc.), solubility enhancer, and between about 60% and about 94.5% by weight of water and/or alternatively other solvents (such as alcohol, glycol, glycol ether, etc.). In still another surfactant composition embodiment, a surfactant composition includes between about 15% and about 30% by weight of sodium low 2-phenyl linear alkylbenzene sulfonate surfactant, between about 0.8% and about 8% by weight of polyethylene glycol solubility enhancer (such as POGOL 400™, etc.), and between about 62% and about 84.2% by weight of water and/or alternatively other solvents (such as alcohol, glycol, glycol ether, etc.). With benefit of this disclosure, it will be understood by those of skill in the art that a surfactant composition may take the form of a liquid or alternatively a paste or solid form, depending on the molecular weight of the LAS and polyethylene glycol components, and/or if the amount of solvent is greatly reduced or eliminated.

In other typical embodiments, a low 2-phenyl linear alkylbenzene-based sulfonate surfactant composition may also contain optional additives including, but not limited to, cationic co-surfactant, anionic co-surfactant, nonionic co-surfactant, detergency builder, enzyme, enzyme oxidation scavenger, soil suspending agent, soil-release polymer, bactericide, coloring agent, foam control agent, corrosion inhibitor, perfume, or a mixture thereof. Examples of such suitable additives include, but are not limited to, those additives described in pending PCT Application No. PCT/US97/06473 (International Publication No. W097/39089), which is incorporated herein by reference.

EXAMPLES

The following examples are illustrative and should not be construed as limiting the scope of the invention or claims thereof.

Example 1

Heavy Duty Liquid Detergent ("HDLD") Formulations

The heavy duty liquid detergent ("HDLD") formulation of Table 1 was made with a variety of LAS sodium salt materials: "LAS-99" (a high two-phenyl LAS obtained from Pilot Chemical Company) and three products made from Huntsman Specialty Chemicals Corporation low two-phenyl LAB materials: sulfonated ALKYLATE 215™, sulfonated ALKYLATE 225™, and sulfonated ALKYLATE 229™. In this regard, ALKYLATE 215™ is a refined mixture of homologs of linear monalkylbenzene ranging in alkyl chain length between 10 and 12 (average 11.1), and having an average molecular weight of between about 232 and about 238. ALKYLATE 225™ is a refined mixture of homologs of linear monalkylbenzene ranging in alkyl chain length between 10 and 13 (average 11.6), and having an average molecular weight of between about 238 and about 246. ALKYLATE 229™ is a refined mixture of homologs of linear monalkylbenzene ranging in alkyl chain length between 10 and 14 (average 12.6), and having an average molecular weight of between about 250 and about 256. Sulfonation typically increases the molecular weight of a compound by about 80.

TABLE 1

HDLD Detergent Prototype

| Ingredients* | Grams | Percent |
|---|---|---|
| LAS, sodium salt | 27.6 | 13.8% |
| Calfoam ES-303 | 33.3 | 5.0% |
| SURFONIC L24-9 ™ | 15.8 | 7.9% |
| Citric Acid | 11.6 | 5.8% |
| $Na_2SO_4$ (Sodium Sulfate) | 0.6 | 0.3% |
| NaCl (Sodium Chloride) | 0.2 | 0.1% |
| Monoethanolamine (MEA) | 12.2 | 6.1% |
| D.I. Water | 98.7 | 61.0% |

*Conventional Caustic (1:1) was added to obtain a pH greater than about 8.5 to about 9.5. This is typical for commercial detergent formulations, and was employed in the HDLD composition examples herein.

The following table indicates the results observed at ambient temperature:

TABLE 2

Appearance Of HDLD Compositions

| LAS Employed | Appearance of the Formulation |
|---|---|
| "LAS-99" (High 2-Phenyl) | clear liquid |
| ALKYLATE 215 ™-Based (Low 2-Phenyl) | slightly hazy liquid |
| ALKYLATE 225 ™-Based (Low 2-Phenyl) | opaque liquid |
| ALKYLATE 229 ™-Based (Low 2-Phenyl) | opaque liquid |

The results in the table illustrate that solubilization is typically needed in order to obtain clear solutions of low 2-phenyl linear alkyl benzene sulfonates.

Example 2

Freeze/Thaw Evaluations of HDLD Formulated with Low 2-Phenyl LAS

Freeze-thaw evaluations were performed on a low 2-phenyl linear alkylbenzene sulfonate liquid laundry detergent prototype having ingredients or components as indicated in Table 1. By "freeze-thaw stability" it is meant that the composition remained isotropic or clear after being frozen hard and then allowed to slowly return to reliquify at room temperature. In this example, a number of different additive materials were evaluated with the detergent prototype to determine the amount of additive needed to achieve freeze-thaw stability.

All Dowfax materials are from Dow Chemical Co. and are mixtures of sulfonated alkyldiphenyl ethers. The SXS used is sodium xylene sulfonate which is available from Huntsman Corporation and other commercial sources. A separate prototype was formulated to test each of the additives, as indicated. Amount of each additive was increased, and the resulting solution tested by means of a freeze/thaw cycle until freeze-thaw stability was achieved. Identity and amounts of these additives required for stability are listed in Table 3 for compositions made with ALKYLATE 225A™ based compositions. As may be seen by the results in Table 3, a much lower concentration of the tested low molecular weight polyethylene glycol (POGOL 600™) was required to obtain stability, in comparison to the conventional additives tested.

TABLE 3

Low 2-Phenyl HDLD Freeze-Thaw Stability Comparison
ADDITIVE INFORMATION

| Additive | Grams of Additive | Achieve Freeze-Thaw Stability |
|---|---|---|
| DMEA | 27.7 | YES |
| MDEA | 44.8 | YES |
| TEA | 12.2 | NO |
| DGA | 27.0 | NO |
| MEA | 19.2 | NO |
| AEEA | 27.0 | NO |

"DMEA" = dimethyl ethanol amine
"MEA" = monoethanol amine
"DGA" = diglycol amine, or 2-(2-aminoethoxy)ethanol
"MDEA" = methylethanol amine
"AEEA" = aminoethyl ethanolamine
"DMAPA" = dimethlyaminopropyl amine
"TEA" = triethanol amine Additional tests were made using known hydrotropes to prepare an isotropic HDLD formulation made with the low 2-phenyl LAS based on ALKYLATE 225™ that is freeze-thaw stable. The hydrotropes used were: Dowfax detergent (35% active), Dowfax 2A1 (45% active), Dowfax 3B2 (46% active) and SXS (40% active). Sodium hydroxide was added, when necessary, to these formulations to maintain a pH>9. Results are shown in Table 4, and illustrate the relatively large amounts of conventional additives needed to achieve freeze/thaw stability.

TABLE 4

Low 2-Phenyl HDLD Freeze-Thaw Stability with Other Additives

| Additive | Amount | Freeze/Thaw Stable | Rate Freeze/Thaw Recovery |
|---|---|---|---|
| Dowfax Detergent | 3.0 gm | Hazy at Ambient | — |
| | 15.0 gm | No | — |
| | 30.0 gm | Yes | Slow |
| Dowfax 2A1 | 2.2 gm | Hazy at Ambient | — |
| | 11.0 gm | No | — |
| | 22.0 gm | Yes | Moderate |
| Dowfax 3B2 | 2.2 gm | Hazy at Ambient | — |
| | 11.0 gm | Yes | Moderate |
| | 22.2 gm | Yes | Fast |
| None | — | Hazy/Separates on Standing | — |
| SXS | 54.3 gm | Yes | Moderate |

The significance of the results shown in Tables 3 and 4 is that the data shows polyethylene glycol material to be as good as or better than known solubilizers (hydrotropes, etc.) for the solubilization of sodium LAS at lower amounts of additive.

In additional testing, it was observed that the comparison HDLD formulation made with LAS-99 (the high two-phenyl LAS from Pilot Chemical), had a moderate rate of recovery from the frozen state. Although it was freeze-thaw stable, it was noted that the recovery rate for the HDLD formulation became very slow after the third freeze-thaw cycle. To be considered freeze-thaw stable, a sample had to pass five freeze-thaw cycles with no lasting separation into layers.

Table 5 illustrates POGOL 600™ combined with ALKYLATE 225™ and other materials that were evaluated.

TABLE 5

Low 2-Phenyl HDLD Evaluated With
Polyethylene Glycol/Amine Additive Mixtures

| Amount POGOL 600 ™ | Additive - Amount * | Freeze-Thaw Stable? | Improved Recovery? |
|---|---|---|---|
| 5.0 gm | O-5 - 22.4 gm | No (gel) | — |
| 5.0 gm | O-15 - 41.2 gm | No (gel) | — |
| 5.0 gm | T-X - 15.8 to 40.9 gm X = 2, 5 or 15 | No (gel) | — |
| 5.0 gm | TEA - 6.7 gm | No | — |
| 5.0 gm | MEA - 2.7 gm | No | — |
| 5.0 gm | DMEA - 4.0 gm | Yes | No |
| 5.0 gm | MDEA - 5.4 gm | Yes | Yes |
| 5.0 gm | MEA - 4.3 gm + Coco Fatty Acid - 4.7 gm | No | — |
| 5.0 gm | TEA - 10.4 gm + Coco Fatty Acid - 4.7 gm | No | — |
| 5.0 gm | DMEA - 6.3 gm + CoCo Fatty Acid - 4.7 gm | Yes | Yes |

* Materials evaluated in the above table, or which may alternatively be utilized in compositions with polyethylene glycols are:
"O-5" = oleylamine 5 mole ethoxylate
"O-15" = oleylamine 15 mole ethoxylate
"T-X" = tallowamine (2, 5 and 15 ethoxylates)
"DMEA" = dimethyl ethanol amine
"MEA" = monoethanol amine
"DGA" = diglycol amine, or 2-(2-aminoethoxy)ethanol
"MDEA" = methylethanol amine
"AEEA" = aminoethyl ethanolamine
"DMAPA" = dimethlyaminopropyl amine
"TEA" = triethanol amine Table 6 shows cloud points and clear points for the freeze-thaw stable HDLD formulations identified. All of these HDLD formulations were low 2-phenyl LAS made with ALKYLATE 225™ except the first formulation listed. The first formulation corresponds to Comparative Example B, was made with LAS-99 (high 2-phenyl material from Pilot Chemical), and contained no other additives.

TABLE 6

HDLD Cloud Point/Clear Point Comparison

| Additive(s) | Cloud Point | Clear Point |
|---|---|---|
| "LAS-99" (High 2-Phenyl with No Additive) | −6.8 | −2.9 |
| SXS (36.2 SXS) | −12.0 | −2.9 |
| SXS (54.3 SXS) | −10.7 | +4.4 |
| Dowfax 2A1 | −12.0 | −2.6 |
| Dowfax 3B2 (11.0 g 3B2) | −13.6 | −1.7 |
| Dowfax 3B2 (22.2 g 3B2) | −15.4 | +1.7 |
| DMEA | −18.1 | −1.7 |
| MDEA | −12.9 | −6.1 |
| POGOL 600 ™ | −8.5 | −2.6 |
| POGOL 600 ™/MDEA | −13.7 | 0.0 |
| POGOL 600 ™/DMEA | −13.7 | +0.6 |

Example 3

LAS Solutions with Polyethylene Glycol—No Sodium Sulfate Salt Added ("No Salt")

The following examples do not use a full HDLD formulation but rather an aqueous solution of 21.4% by weight sodium LAS only. Cloud point and clear points of the sodium LAS solutions were evaluated with the addition of solubilization enhancement materials in increments by weight. In all experiments ALKYLATE 225™ based LAS-acid was used. This LAS-acid was neutralized with sodium hydroxide, as described in the SLAS preparation section below, to a pH of ≧8. However, sodium hydroxide was not added to the point where it "salted out" the SLAS (the point at which SLAS separates from solution as a solid phase).

LAS Test Solution Preparation

In the following examples, test sodium LAS materials were prepared having the following composition:

| | |
|---|---|
| LAS - Acid = 5.000 gm | (20%) |
| Sodium Hydroxide = 0.653 gm | (2.61%) |
| Water = 19.353 gm. | (77.39%) |

This composition, when expressed in terms of the neutralized LAS materials is as follows:

| | |
|---|---|
| Sodium LAS = 5.324 gm | (21.4%) |
| Water = 19.665 gm | (78.6%) |

The percent compositions that are attained, as the increments of additive are added, are shown in Tables 7–14. They are shown as percent based on LAS-acid.

Cloud/Clear Point Evaluation Procedure

For use in the experiments with sodium LAS solutions, a special cloud point/clear point determination apparatus was fabricated. It consisted of a jacketed cell which contained isopropanol. Isopropanol was also passed from a cooler through the outside of the cell jacket. Temperatures of below −20° C. could be attained for this circulating isopropanol. Temperatures well below −10° C. could be achieved for test sample immersed in the isopropanol contained in the cell. A test tube which contained the sample to be evaluated and a thermometer was immersed in the cell isopropanol and evaluated for cloud development under conditions of continuous mixing by means of the thermometer. The temperature at which a resistant cloud developed was identified as the cloud point.

Clear points were determined by letting the test sample, in the test tube, warm slowly, after complete clouding, under ambient conditions, until a state of complete isotropic appearance was attained. The sample, while warming, was stirred intermittently by means of the thermometer that remained in the test tube. The temperature at which the test sample became isotropic was recorded as the clear point.

Note that for HDLD solutions, a similar procedure was used, except that a test tube was immersed in ice and salt to determine the cloud points.

Cloud/Clear Point Results

The value of ([Additive]/([Additive]+[SLAS]))×100 is given in Table 15 as a measurement of additive efficacy ("EF"). This represents the percent of the total SLAS plus additive used that is additive. This value, for each additive, as the cloud point reaches 0° C. or below for the first time may be used as an indicator of additive efficacy. The lower this number is, the more efficacious the additive. The above equation is represented herein by "EF".

In Example 3, cloud point/clear point determinations were also made for solutions containing a low 2-phenyl linear alkylbenzene sulfonate surfactant ("LAS") in the presence of varying amounts of the disclosed polyethylene glycol solubility enhancers. Initially, each solution contained 5.0 g low 2-phenyl linear alkylbenzene sulfonic acid prepared from ALKYLATE 225™ available from Huntsman Specialty Chemicals Corporation, neutralized with 0.653 g sodium hydroxide, and 19.353 g water. Incremental amounts of polyethylene glycol solubility enhancing agent were added by titration to each solution, and cloud points and clear points were then determined.

Tables 7, 8 and 9 contain detailed information regarding cloud points and clear points of low 2-phenyl linear alkylbenzene sulfonate solutions to which one of the disclosed polyethylene glycol solubility enhancers has been added (POGOL 200™, POGOL 300™, or POGOL 900™, available from Huntsman Chemical Corporation). Table 15 contains a summary of the results of Example 3, as well as the results of Comparative Example A.

Table 15 shows the first cloud point attained below 0° C. (if any), the lowest cloud point attained, and the clear point corresponding to the 0° C. cloud point concentration or, alternatively (in the cases where the cloud point remained above 0° C.), the lowest clear point attained for each additive tested. Table 15 additionally presents the amount of each additive tested both as a percentage by weight of the entire solution, and as a percentage by weight of the amount of low 2-phenyl alkylbenzene sulfonate and additive present in solution. As can be seen from these results, all three polyethylene glycol materials tested were capable of attaining a lower cloud point (−7° C.) than the conventional additives tested. Furthermore, a much greater percentage by weight of each of the conventional additives of Comparative Example A was required to produce a solution with a cloud point less than 0° C., relative to the polyethylene glycol materials.

As may be seen from the data in Tables 7, 8 and 9 both cloud and clear points were lowered substantially by addition of each of the tested polyethylene glycol solubility enhancers. Referring to Table 15, lower values of % additive (expressed as a function of weight of additive and alkylbenzene sulfonate, and also as function of weight of total solution) indicate less of the disclosed polyethylene glycol additives than the tested conventional additives were required to make the 225A™ low 2-phenyl linear alkylbenzene sulfonate sodium salt soluble in a water solution. In this regard, lower cloud points and clear points were achieved using lower amounts of polyethylene glycol additives (POGOL 200™, POGOL 300™, and POGOL 900™) than were achieved with the conventional additives tested. In the aqueous solution, it may be seen that half of the amount, or less, POGOL 300™ are needed to attain cloud points lower than those of the best-performing tested hydrotrope ("DOWFAX 3B2").

The results summarized in Table 15 clearly indicate the superiority of three polyethylene glycol materials (POGOL 200™, POGOL 300™, and POGOL 900™) for improving the solubility of a low 2-phenyl linear alkylbenzene sulfonate surfactant in comparison to the performance of several known conventional solubility-enhancing additives tested in Comparative Example A.

TABLE 7

| LAS Solution With No Sodium Sulfate Salt Added Addition of POGOL 200 ™ | | | | | |
|---|---|---|---|---|---|
| Solution # | 200-1 | 200-2 | 200-3 | 200-4 | 200-5 |
| % LAS acid (by wt.) | 20.00 | 19.60 | 18.86 | 17.85 | 16.66 |
| % $H_2O$ | 77.39 | 75.88 | 73.01 | 69.10 | 64.50 |
| % NaOH (1:1) | 2.61 | 2.56 | 2.46 | 2.33 | 2.18 |
| % POGOL 200 ™ | 0 | 1.96 | 5.66 | 10.71 | 16.66 |
| Cloud Point (° C.) | 20 | 3 | −4 | −4 | −7 |
| Clear Point (° C.) | 16 | 6 | 2 | 3 | −1 |

TABLE 8

| LAS Solution With No Sodium Sulfate Salt Added Addition of POGOL 300 ™ | | | | | | |
|---|---|---|---|---|---|---|
| Solution # | 300-1 | 300-2 | 300-3 | 300-4 | 300-5 | 300-6 |
| % LAS acid (by wt.) | 20.00 | 19.23 | 18.51 | 17.85 | 17.24 | 16.66 |
| % $H_2O$ | 77.39 | 74.42 | 71.66 | 69.10 | 66.77 | 64.50 |
| % NaOH (1:1) | 2.61 | 2.51 | 2.42 | 2.33 | 2.25 | 2.18 |
| % POGOL 300 ™ | 0 | 3.85 | 7.41 | 10.71 | 13.79 | 16.66 |
| Cloud Point (° C.) | 20 | −4 | −5 | −5 | −5.5 | −7 |
| Clear Point (° C.) | 14 | 4 | 4 | 4 | 2 | 3 |

TABLE 9

| LAS Solution With No Sodium Sulfate Salt Added Addition of POGOL 900 ™ | | | | | |
|---|---|---|---|---|---|
| Solution # | 900-1 | 900-2 | 900-3 | 900-4 | 900-5 |
| % LAS acid (by wt.) | 20.00 | 19.23 | 18.51 | 17.85 | 17.24 |
| % $H_2O$ | 77.39 | 74.42 | 71.66 | 69.10 | 66.72 |
| % NaOH (1:1) | 2.61 | 2.51 | 2.42 | 2.33 | 2.25 |
| % POGOL 900 ™ | 0 | 3.85 | 7.41 | 10.71 | 13.79 |

TABLE 9-continued

| LAS Solution With No Sodium Sulfate Salt Added Addition of POGOL 900 ™ | | | | | |
|---|---|---|---|---|---|
| Solution # | 900-1 | 900-2 | 900-3 | 900-4 | 900-5 |
| Cloud Point (° C.) | 16 | 0 | −5 | −6 | −7 |
| Clear Point (° C.) | 15 | 3 | 4 | 4 | 2 |

Comparative Example A

In this example, cloud point/clear point determinations were made using the solution containing low 2-phenyl linear alkylbenzene sulfonate surfactant of Example 3. In this example, incremental amounts of conventional solubility enhancing agents were added by titration to each solution, and cloud points and clear points were then determined.

Tables 10–14 contain detailed information regarding clear points and cloud points of low 2-phenyl linear alkylbenzene sulfonate solutions to which one of the conventional solubility enhancing agents has been added ("SXS", "MDEA", "DMEA", "DOWFAX 3B2", or "DOWFAX HYDRO").

The lowest cloud points attained by SXS, DMEA or MDEA did not go below 0° C. This is in contrast to the cloud point values shown for the HDLD formulations that contained these same solubility enhancers.

Sodium xylene sulfonate ("SXS") is commonly employed as hydrotrope and solubilization agent. MDEA is methyldiethanol amine and DMEA is dimethylethanol amine. Both of these amines are employed as solubilization agents for other surfactant systems. SXS, MDEA and DMEA are commercially available from Huntsman Specialty Chemicals Corporation. The Dowfax materials are mixtures of sulfonated alkyldiphenyl ethers commercially available from Dow Chemical Co. These are commonly well known hydrotropes and solubilization agents.

TABLE 10

| LAS Solution with No Sodium Sulfate Salt Added Addition of SXS | | | | | | | | | | | | |
|---|---|---|---|---|---|---|---|---|---|---|---|---|
| Solution # | SXS-1 | SXS-2 | SXS-3 | SXS-4 | SXS-5 | SXS-6 | SXS-7 | SXS-8 | SXS-9 | SXS-10 | SXS-11 | SXS-12 |
| % LAS acid (by wt.) | 20.00 | 18.18 | 16.66 | 15.38 | 14.28 | 13.33 | 12.88 | 12.50 | 12.10 | 11.74 | 11.41 | 11.11 |
| % $H_2O$ | 77.39 | 75.81 | 74.50 | 73.38 | 72.42 | 71.60 | 71.21 | 70.87 | 70.53 | 70.21 | 69.93 | 69.66 |
| % NaOH (1:1) | 2.61 | 2.37 | 2.18 | 2.01 | 1.87 | 1.74 | 1.68 | 1.63 | 1.58 | 1.53 | 1.49 | 1.45 |
| % SXS | 0 | 3.64 | 6.67 | 9.23 | 11.43 | 13.33 | 14.22 | 15.00 | 15.78 | 16.52 | 17.17 | 17.78 |
| Cloud Point (° C.) | 10 | 22 | 21 | 14 | 6 | 4 | 3 | 3 | 2 | 2 | 2 | 2 |
| Clear Point (° C.) | 14 | 23 | 21 | 15 | 8 | 5 | 4 | 4 | 3 | 3 | 3 | 3 |

TABLE 11

| LAS Solution with No Sodium Sulfate Salt Added Addition of MDEA | | | | | | | | |
|---|---|---|---|---|---|---|---|---|
| Solution # | MDEA-1 | MDEA-2 | MDEA-3 | MDEA-4 | MDEA-5 | MDEA-6 | MDEA-7 | MDEA-8 |
| % LAS acid (by wt.) | 20.00 | 19.23 | 18.51 | 17.85 | 17.24 | 16.66 | 16.39 | 16.13 |
| % $H_2O$ | 77.39 | 74.42 | 71.66 | 69.10 | 66.72 | 64.50 | 63.44 | 62.42 |
| % NaOH (1:1) | 2.61 | 2.51 | 2.42 | 2.33 | 2.25 | 2.18 | 2.14 | 2.11 |
| % MDEA | 0 | 3.85 | 7.41 | 10.71 | 13.79 | 16.66 | 18.03 | 19.35 |
| Cloud Point (° C.) | 19 | 17 | 10 | 9 | 6 | 5 | 6 | 6 |
| Clear Point (° C.) | 15 | 13 | 9 | 6.5 | 5.5 | 6 | 5.5 | 5.5 |

TABLE 12

LAS Solution with No Sodium Sulfate Salt Added Addition of DMEA

| Solution # | D-1 | D-2 | D-3 | D-4 | D-5 | D-6 | D-7 | D-8 | D-9 | D-10 | D-11 | D-12 |
|---|---|---|---|---|---|---|---|---|---|---|---|---|
| % LAS acid (by wt.) | 20.00 | 19.23 | 18.51 | 17.85 | 17.24 | 16.66 | 16.39 | 16.13 | 15.87 | 15.62 | 15.38 | 13.89 |
| % $H_2O$ | 77.39 | 74.42 | 71.66 | 69.10 | 66.72 | 64.50 | 63.44 | 62.42 | 61.43 | 60.47 | 59.54 | 53.75 |
| % NaOH (1:1) | 2.61 | 2.51 | 2.42 | 2.33 | 2.25 | 2.18 | 2.14 | 2.11 | 2.07 | 2.04 | 2.01 | 1.81 |
| % DMEA | 0 | 3.85 | 7.41 | 10.71 | 13.79 | 16.66 | 18.03 | 19.35 | 20.63 | 21.87 | 23.07 | 30.55 |
| Cloud Point (° C.) | — | 9 | 8 | 6 | 8 | 7 | 7 | 7 | 7 | 7 | — | 6 |
| Clear Point (° C.) | — | 11 | 9 | 7 | 8 | 8 | 7 | 7 | 7 | 7 | — | 7 |

TABLE 13

LAS Solution with No Sodium Sulfate Salt Added Addition of DOWFAX 3B2

| Solution # | 3B2-1 | 3B2-2 | 3B2-3 | 3B2-4 | 3B2-5 | 3B2-6 |
|---|---|---|---|---|---|---|
| % LAS acid (by wt.) | 20.00 | 18.31 | 17.00 | 15.77 | 14.75 | 13.85 |
| % $H_2O$ | 77.39 | 75.51 | 74.04 | 72.66 | 71.52 | 70.51 |
| % NaOH (1:1) | 2.61 | 2.39 | 2.22 | 2.06 | 1.93 | 1.01 |
| % Dowfax 3B2 | 0 | 3.79 | 6.73 | 9.51 | 11.81 | 13.83 |
| Cloud Point (° C.) | 18 | 5 | 1 | −2 | −3 | −4 |
| Clear Point (° C.) | 14 | 7 | 5 | 3 | 4 | 3 |

TABLE 14

LAS Solution with No Sodium Sulfate Salt Added Addition of DOWFAX HYDRO

| Solution # | HY-1 | HY-2 | HY-3 | HY-4 | HY-5 | HY-6 | HY-7 | HY-8 |
|---|---|---|---|---|---|---|---|---|
| % LAS acid (by wt.) | 20.00 | 18.45 | 17.12 | 15.97 | 14.97 | 14.08 | 13.66 | 13.30 |
| % $H_2O$ | 77.39 | 75.43 | 73.74 | 72.28 | 71.01 | 69.88 | 69.35 | 68.89 |
| % NaOH (1:1) | 2.61 | 2.41 | 2.24 | 2.09 | 1.95 | 1.84 | 1.78 | 1.74 |
| % DOWFAX HYDRO | 0 | 3.72 | 6.90 | 9.66 | 12.07 | 14.19 | 15.21 | 16.08 |
| Cloud Point (° C.) | 20 | 11 | 8 | 3 | −2 | −6 | −6 | −6 |
| Clear Point (° C.) | 15 | 15 | 10 | 9 | 7 | 4 | 4 | 3 |

TABLE 15

LAS Solution with No Sodium Sulfate Salt Added Summary of Experiments Detailed in Tables 7–14

| Additive | First Cloud Point Below 0° C. | Clear Point, ° C. | 100(x){Additive/(Additive + LAS)} | % Additive by Wt. of solution | Lowest Cloud Point, ° C. |
|---|---|---|---|---|---|
| SXS | none | 3 | 50.82 | 14.2 | +2 |
| Dowfax 3B2 | −2 | 3 | 36.08 | 9.5 | −4 |
| DOWFAX HYDRO | −2 | 7 | 43.01 | 12.1 | −6 |
| DMEA | none | 7 | 48.35 | 16.7 | 7 |
| MDEA | none | 6 | 48.35 | 16.7 | 5 |
| POGOL 200 ™ | −4 | 2 | 21.92 | 5.7 | −7 |
| POGOL 300 ™ | −4 | 4 | 15.77 | 3.8 | −7 |
| POGOL 900 ™ | −5 | 4 | 27.24 | 7.4 | −7 |

Comparative Example B

HDLD Composition Formulated with High 2-Phenyl LAS

For comparison purposes, cloud point data were also obtained for the high 2-phenyl linear alkylbenzene sulfonate HDLD composition formulated according to Table 1 (in this case containing "LAS-99", a high 2-phenyl product available from Pilot Chemical Company), and sodium hydroxide, with no additive present. Results for this composition are shown in Table 6. Significantly, the high 2-phenyl linear alkylbenzene sulfonate solution displayed a lowest cloud point (−6.8° C.) comparable to those attainable with a less costly low 2-phenyl linear alkylbenzene sulfonate in the presence of the disclosed polyethylene glycol solubility enhancer POGOL 600, as indicated by the results of Example 2, and as shown in Table 6.

Example 4

Cloud Points of HDLD Formulated with Low 2-Phenyl LAS and Various Additives

In a manner similar to that employed for Example 2, cloud points using polyethylene glycol and conventional additives were also determined for a heavy duty liquid detergent ("HDLD") formulation. In this case, POGOL 600™ was the tested polyethylene glycol solubility enhancer. Test results are presented in Table 16, wherein it may be observed that POGOL materials are as effective for obtaining desirable cloud points for low 2-phenyl LAS materials as the more expensive hydrotrope Dowfax 3B2. Furthermore, as outlined in Table 16 much less POGOL 600 was needed to get a desirable cloud point than was observed for SXS, DMEA or MDEA.

TABLE 16

Effect of Various Additives on Cloud Point of a Low 2- Phenyl Heavy Duty Liquid Detergent Formulation ("HDLD")

| Additive | 100(x){Additive/(Additive + LAS)} | Cloud Point ° C. (Lowest) |
|---|---|---|
| SXS | 34.41 | −12.1 |
| DowFax 3B2 | 26.83 | −13.6 |
| DMEA | 35.99 | −18.2 |
| MDEA | 54.27 | −12.9 |
| POGOL 600 ™ | 26.60 | −8.5 |

Example 5

Sodium LAS ("SLAS") Solution Using Modified Solubility Titration Method (Sodium Sulfate Added)

The following two sets of experiments were carried out by a modified solubility titration method. In these experiments, neutralization of the LAS-Acid was accomplished with sodium hydroxide (final pH of 8.5 to 9.5). The sodium LAS was "salted out" with a known amount of sodium sulfate before adding the additive.

SLAS Preparation

Neutralization of the LAS-acid was conducted as before but under more controlled conditions. As an example, the following procedure for making an approximate 20% ALKYLATE 222™ LAS solution useful for the evaluation of clear/cloud points was followed. A total of 1440 grams of test solution was made, and 25 gram samples were used for the actual test runs. A final sodium LAS concentration in the 25 gram test sample was calculated to be approximately 23.7%.

The following preparation procedure was employed: 339.2 grams of the ALKYLATE 225™ LAS-acid and an appropriate mechanical stirrer were placed into a clean beaker. Next, 1100.0 grams of cool, deionized water was added, followed by a slow addition of 86.77 grams of a 1:1 NaOH/deionized water solution. The resulting mixture was vigorously stirred by the mechanical mixer, with ice bath cooling as required to maintain near ambient temperature for 45 to 60 minutes. A final solution pH measurement afforded a value of 9.0.

SLAS "Salted Out" Test Solution Preparation

The test solution was prepared by the following procedures.

1) The following materials were placed into the test cell:

12.933 grams of SLAS (23.7% active)

12.575 grams of Deionized water

2) The resulting solution was then mixed and shaken until a clear isotropic solution was obtained.

3) The following material was then added to the solution:

5 0.565 grams of sodium sulfate

4) The solution was then shaken and mixed until all of the sodium sulfate went into solution and the entire solution was uniformly hazy (milky) in appearance. This solution had a cloud point of about 30° C.

5) In each case, about 0.20 grams of the selected additive was added to this solution and the cloud point and clear point determinations made.

6) Increments of about 0.20 grams of the selected additive were then added and the cloud point retaken after each such addition until a total of about 2.6 grams of the selected additive had been added.

Results are given in Table 17.

TABLE 17

LAS Solution with Sodium Sulfate Salt Added

| Additive | First Cloud Point Below 0° C. | Clear Point, ° C. | 100(x) {Additive/ (Additive + LAS)} | % Additive by Wt. of Solution | Lowest Cloud Point, ° C. |
|---|---|---|---|---|---|
| POGOL 300 ™ | −2 | 1 | 35.5 | 6.2 | −4 |
| POGOL 400 ™ | −2 | 14 | 25.4 | 3.9 | 5 |
| POGOL 500 ™ | −1 | 15 | 21.4 | 3.2 | −8 |
| POGOL 600 ™ | −4 | 9 | 29.7 | 4.8 | −7 |
| POGOL 900 ™ | −3 | 8 | 25.5 | 4 | −7 |

TABLE 18

Molecular Weights Of Linear Alkyl Benzenes

| R = Alkyl Group | R-phenyl ring LAB | R-phenyl-$SO_3$-acid LAS-acid | R-phenyl-$SO_3Na$ Sodium LAS |
|---|---|---|---|
| R = $C_8$ | 190 | 270 | 292 |
| R = $C_{10}$ | 218 | 298 | 320 |
| R = $C_{11}$ | 232 | 312 | 334 |
| R = $C_{12}$ | 246 | 326 | 348 |
| R = $C_{13}$ | 260 | 340 | 362 |
| R = $C_{14}$ | 274 | 354 | 376 |
| R = $C_{16}$ | 302 | 382 | 404 |

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed compositions and methods may be utilized in various combinations and/or independently. Thus the invention is not limited to only those combinations shown herein, but rather may include other combinations.

What is claimed is:

1. A surfactant composition consisting essentially of a solvent, from about 2% to about 40% of alkylbenzene sulfonate by total weight of said composition, and from about 0.2% to about 20% polyethlene glycol by total weight of said composition;

wherein said linear alkylbenzene sulfonate has a 2-phenyl isomer content of from about 14% to less than or equal to 25% by weight; and wherein said surfactant composition is a liquid aqueous solution.

2. The surfactant composition of claim 1, wherein said alkylbenzene sulfonate is a low 2-phenyl alkylbenzene sulfonate.

3. The surfactant composition of claim 1, wherein said alkylbenzene sulfonate is a linear alkylbenzene sulfonate having a 2-phenyl isomer content of less than or equal to 25% by weight.

4. The surfactant composition of claim 2, wherein said alkylbenzene sulfonate is a linear alkylbenzene sulfonate having a 2-phenyl isomer content of up to about 20% by weight.

5. The surfactant composition of claim 3, wherein a cation of said low 2-phenyl alkylbenzene sulfonate comprises at least one of ammonium, a substituted ammonium, an alkali metal, an alkaline earth metal, or a mixture thereof.

6. The surfactant composition of claim 5, wherein said alkali metal comprises sodium.

7. The surfactant composition of claim 3, wherein said polyethylene glycol solubility enhancer has an average molecular weight from about 200 to about 900.

8. The surfactant composition of claim 3, wherein said low 2-phenyl alkylbenzene sulfonate is present in an amount from about 15% to about 30% by total weight of said composition, and wherein said polyethylene glycol solubility enhancer is present in an amount from about 0.8% to about 8% by total weight of said composition.

9. A surfactant composition consisting essentially of a solvent, from about 2% to about 40% of linear alkylbenzene sulfonate by total weight of said composition, and from about 0.2% to about 20% polyethylene glycol by total weight of said composition;

wherein said linear alkylbenzene sulfonate has a 2-phenyl isomer content of from about 14% to less than or equal to 25% by weight;

wherein said surfactant composition is an aqueous solution.

10. The surfactant composition of claim 9, wherein said solvent comprises water and at least one of alcohol, glycol, glycol ether, or a mixture thereof.

11. The surfactant composition of claim 10, wherein said solvent comprises water and at least one of alcohol having from 1 to about 6 carbon atoms, or a mixture thereof.

12. The surfactant composition of claim 9, wherein an alkyl chain of said alkylbenzene sulfonate surfactant contains from about 8 to about 16 carbon atoms.

13. The surfactant composition of claim 9, wherein a cation of said linear alkylbenzene sulfonate surfactant comprises sodium.

14. The surfactant composition of claim 9, wherein said polyethylene glycol solubility enhancer has a molecular weight between about 200 and about 900.

15. The surfactant composition of claim 13, wherein a cloud point of said surfactant composition is from about 10° C. to about −15° C.

16. The surfactant composition of claim 13, wherein the clear point of said surfactant solution is from about 15° C. to about −5° C.

17. The surfactant composition of claim 13, having a reduction in cloud point of between about 10° C. and about 40° C.

18. The surfactant composition of claim 13, having a reduction in clear point of between about 10° C. and about 40° C.

19. A surfactant composition consisting essentially of from about 2% to about 40% low 2-phenyl alkylbenzene sulfonate by total weight of said, composition, from about 0.2% to about 20% polyethylene glycol by total weight of said composition, and from about 97.8% to about 40% solvent by total weight of the composition; and wherein said solvent comprises at least one of water, alcohol, glycol, glycol ether, or a mixture thereof;

wherein an alkyl chain of said low 2-phenyl alkylbenzene sulfonate surfactant contains from about 8 to about 16 carbon atoms; and wherein said polyethylene glycol solubility enhancer has a molecular weight of between about 200 and about 2000;

wherein said surfactant composition is a liquid solution.

20. The surfactant composition of claim 19, wherein said polyethylene glycol solubility enhancer has an average molecular weight of between about 200 and about 900.

21. The surfactant composition of claim 20, wherein said polyethylene glycol solubility enhancer has an average molecular weight of less than 400.

22. The surfactant composition of claim 20, wherein said polyethylene glycol solubility enhancer has an average molecular weight from about 200 to about 300.

23. The surfactant composition of claim 21, wherein said solvent comprises water.

24. The surfactant composition of claim 20, wherein the cloud point of said surfactant composition is from about 15° C. to about −15° C., or wherein the clear point of said surfactant composition is from about 25° C. to about −5° C.

25. The surfactant composition of claim 20, having a reduction in cloud point of between about 10° C. and about 40° C., or having a reduction in clear point of between about 10° C. and about 40° C.

26. The surfactant composition of claim 20, wherein a cation of said 2-phenyl linear alkylbenzene sulfonate surfactant comprises sodium.

27. A method of enhancing solubility of alkylbenzene sulfonate in a solvent, said method comprising:

preparing a liquid solution consisting essentially of said alkylbenzene sulfonate, said solvent, and polyethylene glycol;

wherein said solvent comprises water; and wherein said preparing comprises preparing a liquid solution with a sufficient amount of polyethylene glycol to result in a solution consisting essentially of from about 2% to about 40% low 2-phenyl alkylbenzene sulfonate by total weight of said solution, and from about 0.2% to about 20% polyethylene glycol by total weight of said solution.

28. The method of claim 27, wherein said alkylbenzene sulfonate comprises low 2-phenyl alkylbenzene sulfonate.

29. The method of claim 27, wherein said alkylbenzene sulfonate has a 2-phenyl isomer content of less than or equal to 25% by weight.

30. The method of claim 27, wherein said alkylbenzene sulfonate has a 2-phenyl isomer content of up to about 20% by weight.

31. The method of claim 27, wherein a cation of said 2-phenyl alkylbenzene sulfonate surfactant comprises sodium.

32. The method of claim 27, wherein said polyethylene glycol solubility enhancer has a molecular weight between about 200 and about 900.

33. The method of claim 28, wherein said liquid solution is an aqueous solution; and wherein said preparing comprises adding a polyethylene glycol solubility enhancer to said liquid solution, and lowering the cloud point of said liquid solution to from about 15° C. to about −10° C.; or lowering the clear point of said liquid solution to from about 25° C. to about −5° C.

34. The method of claim 28, wherein said preparing comprises adding a polyethylene glycol to said liquid solution and lowering the cloud point of said liquid solution by between about 10° C. and about 40° C.; or reducing the clear point of said liquid solution by between about 10° C. and about 40° C.

35. A surfactant composition consisting essentially of:

at least one low 2-phenyl linear alkylbenzene sulfonate; and at least one polyethylene glycol solubility enhancer;

wherein said surfactant composition is a liquid aqueous solution;

wherein said polyethylene glycol solubility enhancer is present in an amount effective to lower a cloud point of said surfactant composition to less than 5° C.; and wherein said low 2-phenyl linear alkylbenzene sulfonate is present in an amount from about 2% to about 40% by total weight of said composition, wherein said polyethylene glycol solubility enhancer is present in an amount from about 0.2% to about 20% by total weight of said composition; and wherein a solvent is present in an amount of from about 40% and about 97.8%.

36. The surfactant composition of claim 35, wherein said polyethylene glycol solubility enhancer is present in an amount effective to lower a cloud point of said surfactant composition to less than or equal to about 0° C.

37. The surfactant composition of claim 35, wherein said polyethylene glycol solubility enhancer is present in an amount effective to lower a cloud point of said surfactant composition to from less than about 5° C. to about −8.5° C.

38. The surfactant composition of claim 35, wherein said polyethylene glycol solubility enhancer is present in an amount effective to lower a cloud point of said surfactant composition to from less than about 5° C. to about −4° C.

39. The surfactant composition of claim 37, wherein said polyethylene glycol solubility enhancer is present in an amount effective to lower a cloud point of said surfactant composition to from less than about 0° C. to about −8.5° C.

40. The surfactant composition of claim 37, wherein said polyethylene glycol solubility enhancer is present in an amount effective to lower a cloud point of said surfactant composition to from about 0° C. to about −4° C.

41. The surfactant composition of claim 39, wherein said polyethylene glycol solubility enhancer has an average molecular weight from about 200 to about 900.

* * * * *

UNITED STATES PATENT AND TRADEMARK OFFICE

CERTIFICATE OF CORRECTION

PATENT NO.: 6,083,897
DATED: July 4, 2000
INVENTOR(S): RONALD G. LEWIS and DAVID C. LEWIS It is certified that error appears in the above-identified patent and that said Letters Patent is hereby corrected as shown below:

In claim 19, column 23, line 64, delete "alcohol, glycol, glycol ether," and insert --alcohols having about 1 to 6 carbon atoms, propylene glycol, propylene diglycol, triethylene glycol,--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*